US007537146B2

(12) United States Patent
Schiestl

(10) Patent No.: US 7,537,146 B2
(45) Date of Patent: May 26, 2009

(54) HAND-HELD DRIVE-IN POWER TOOL

(75) Inventor: Ulrich Schiestl, Feldkirch (AT)

(73) Assignee: Hilti Aktiengesllschaft, Schaan (LI)

( * ) Notice: Subject to any disclaimer, the term of this patent is extended or adjusted under 35 U.S.C. 154(b) by 0 days.

(21) Appl. No.: 11/483,350

(22) Filed: Jul. 7, 2006

(65) Prior Publication Data

US 2007/0023472 A1 Feb. 1, 2007

(30) Foreign Application Priority Data

Jul. 13, 2005 (DE) ..... 10 2005 000 089

(51) Int. Cl.
*B25C 1/06* (2006.01)

(52) U.S. Cl. ..... 227/133; 227/131; 227/132; 227/8

(58) Field of Classification Search ..... 227/129, 227/131, 132, 2; 173/202–203, 120, 210
See application file for complete search history.

(56) References Cited

U.S. PATENT DOCUMENTS 1,028,778 A * 6/1912 Schofield ..... 227/132
1,775,188 A * 9/1930 Bowen ..... 173/202
2,575,455 A * 11/1951 Lang ..... 227/138
2,710,964 A * 6/1955 Spencer ..... 227/132
2,787,179 A * 4/1957 Warner ..... 173/115
3,587,754 A * 6/1971 Laatsch ..... 173/107
3,610,505 A * 10/1971 Males et al. ..... 227/127
3,924,692 A * 12/1975 Saari ..... 173/117
3,924,789 A * 12/1975 Avery et al. ..... 227/131
4,645,015 A * 2/1987 Mitchell ..... 173/115
4,662,557 A * 5/1987 Lee ..... 227/147
5,069,379 A * 12/1991 Kerrigan ..... 227/131
5,118,023 A * 6/1992 Fushiya et al. ..... 227/8
5,511,715 A * 4/1996 Crutcher et al. ..... 227/131
6,093,130 A * 7/2000 Buck et al. ..... 475/298
6,755,336 B2 * 6/2004 Harper et al. ..... 227/129
2005/0082334 A1 * 4/2005 Hu ..... 227/131

FOREIGN PATENT DOCUMENTS

DE 4013022 A1 11/1990

* cited by examiner

*Primary Examiner*—Rinaldi I. Rada
*Assistant Examiner*—Lindsay Low
(74) *Attorney, Agent, or Firm*—Abelman, Frayne & Schwab

(57) ABSTRACT

A hand-held drive-in power tool for driving in fastening elements includes a drive-in ram displaceable in a guide located in the tool housing, a drive for driving the drive-in ram and including at least one preloaded drive spring, a tensioning device for preloading the drive spring, and a transmission mechanism arranged between the drive spring and the drive-in ram.

3 Claims, 4 Drawing Sheets

HAND-HELD DRIVE-IN POWER TOOL

BACKGROUND OF THE INVENTION

1. Field of the Invention

The present invention relates to a hand-held drive-in power tool for driving in fastening elements and including a guide, a drive-in ram displaceable in the guide, drive means for driving the drive-in ram and including at least one preload drive spring, and a tensioning device for preloading the drive spring.

2. Description of the Prior Art

Hand-held power tools of the type described above are used for driving fastening elements in a constructional component with the ram. The drive spring serves as a driving source and is preloaded by a tensioning device. The advantage of the above-described tool consists in that the mechanical drive spring can be economically produced which permits to insure a cost-effective manufacturing of the entire power tool. Further, an advantage of mechanical springs over gas springs in general consists in that upon preloading of a mechanical spring, the temperature does not increase as it takes place in gas springs. As a result, a preloaded mechanical spring does not lose the stored energy for a long time, whereas in a gas spring, the stored energy is gradually lost because of leakage.

However, mechanical springs have a drawback in comparison with gas spring that consists in that upon a rapid expansion, a substantial portion of the energy, which is stored in the spring becomes lost as it has to be used for accelerating the spring mass proper. Because the mass of a mechanical spring is much greater than the mass of a gas spring, these losses are much greater than in the gas spring. As a drive-in process that takes place with the drive-in power tool, which is subject of the present invention, leads to a very rapid expansion of the spring, the foregoing circumstance is very noticeable.

A drive-in power tool of the type discussed above is disclosed in German Publication DE 40 13 022 A1. The disclosed power tool includes a spring for driving an impact mechanism toward the tool mouth for driving in a nail. The device for displacing the impact mechanism in its initial position includes an electric motor and a speed reduction mechanism. The rotation of the electric motor is transmitted by the speed reduction mechanism and a crown gear, which forms part of the speed reduction mechanism, to a hammer body of the impact mechanism for displacing the impact mechanism against the biasing force of the drive spring into the initial position in which the impact mechanism is ready for a drive-in process.

The drawback of the drive-in power tool of DE 40 13 022 A1 consists in that the maximal impact energy that can be applied by the spring to the hammer body, about 5-10 joules, is somewhat low. Therefore, such a drive-in tool cannot be used for driving in fastening elements in hard constructional components, such as steel and concrete. This is the result of the above-discussed circumstance that the mechanical spring loses a portion of the stored energy for acceleration of the spring mass, so that this portion is lost for acceleration of the impact mechanism. If the impact energy of the drive-in tool is to be increased, a stronger spring should be used which would store more energy. However, the increase of the spring strength leads to an increase of the spring mass which, in turn, again increases the losses which result from a portion of the energy being spent on the acceleration of the spring mass.

This means that the energy, which is stored by the springs, should be increased in order to increase the setting or drive-in energy. This, in turn, results in a significantly heavier spring, without a noticeable increase of the impact energy of the drive-in power tool.

Accordingly, an object of the present invention is to provide a drive-in power tool in which the drawback of known drive-in power tools are eliminated.

Another object of the present invention is to provide a drive-in power tool in which with simple technical means, a high drive-in energy, together with a high drive-in speed, are achieved.

SUMMARY OF THE INVENTION

These and other objects of the present invention, which will become apparent hereinafter, are achieved by arranging a transmission mechanism between the drive spring and the drive-in ram. This transmission mechanism provides for a lower expansion speed of the drive spring which, in turn, results in a smaller kinetic energy losses in the spring, on one hand and, on the other hand, provides for an increased speed and a longer acceleration path. As a result, a high drive-in speed and, simultaneously, a high setting or drive-in energy are obtained.

Advantageously, the drive spring is supported by a first end of its opposite ends against a power tool housing. With a second end of the opposite ends of the drive spring, the drive spring is connected to a spring output element that connects the drive spring with the transmission mechanism. The spring output element permits the connection of the drive spring with different types of transmission of transmission mechanisms, such as, e.g., rope drives, link mechanisms, gear mechanisms, or planetary gear mechanisms. The spring output element can also connect the drive spring with a hydraulically driven pressure transmission mechanism. However, the spring output element should be correspondingly formed to provide for connection with the transmission mechanism. The drive spring does not require any adaptation. The drive spring can be formed, e.g., as helical or spiral spring, leaf spring, plate spring, tangentially loaded helical spring, or torsion spring.

A good design of the drive-in power tool with the optimal use of the drive spring can be achieved when the transmission mechanism has a transmission ratio of at least 1:1.5.

Advantageously, the transmission mechanism has a transmission ratio between 1:2 and 1:4. Thereby, an optimal compromise between the additional weight of the transmission mechanism and speed gain of the drive-in ram is achieved.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
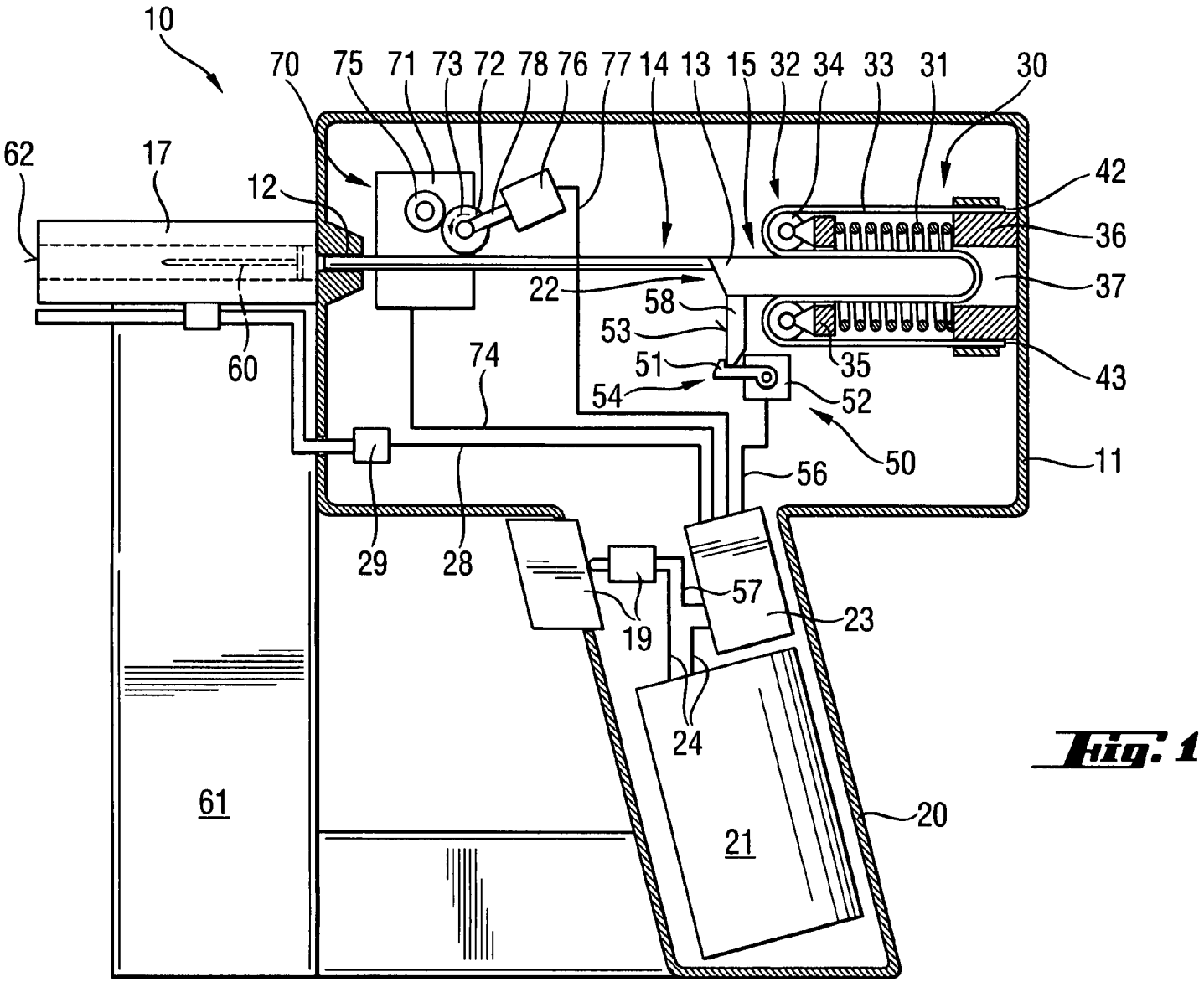
FIG. 1 a longitudinal view of a drive-in power tool according to the present invention in its initial position.
Figure 2:
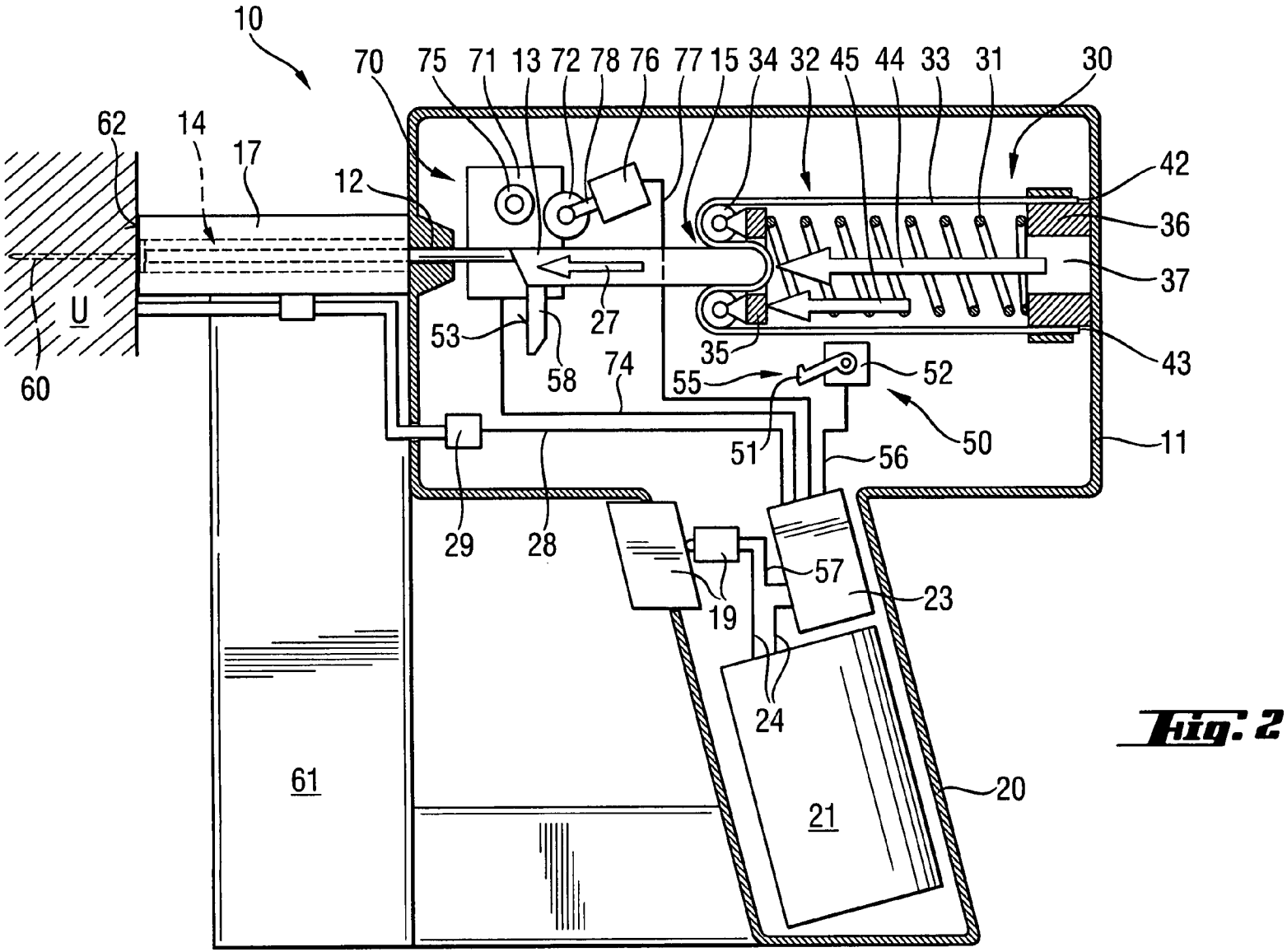
FIG. 2 a longitudinal view of the drive-in power tool according to FIG. 1 in its operational position.

A power tool 10 according to the present invention, which is shown in FIGS. 1-2, has a housing 11 and located in the housing 11, drive means, which is generally indicated with a reference numeral 30, for driving a drive-in ram 13 displaceable in a guide 12 likewise located in the housing 10. The drive-in ram 13 has a driving section 14 and a head section 15. A bolt guide 17 adjoins an end of the guide 12 facing in the drive-in direction 27 and is arranged coaxially with the guide 12. Sidewise of the bolt guide 17, a magazine 61 for fastening elements is arranged. In the magazine 61, fastening elements 60 are stored.

The drive means 30 includes a drive spring 31 and a transmission mechanism, which is generally indicated with a reference numeral 32 and which engages the head section 15 of the drive-in ram 13. The driving force generated by the drive spring 31 is transmitted to the drive-in ram 13 via the transmission mechanism 32. The drive spring 31 is formed as a helical spring. The transmission mechanism 32 is formed in the embodiment shown in FIGS. 1-2 as a rope drive. The drive spring 31 is arranged between an abutment 36 fixedly secured to the housing 10 in an output element 35 which is formed as an annular spring member. At an end of the output element 35 remote from the drive spring 31, two opposite rollers 34 are rotatably supported. A rope-shaped or band-shaped transmission element 33, the first and second free ends 42, 43 of which are secured to the abutment 36, is guided over the rollers 34 about the output element 35. Simultaneously, the transmission element 33 is guided about the free end of the head section 15 of the drive-in ram 13.

In the initial position 22, shown in FIG. 1, the drive-in ram 13 is resiliently preloaded by the transmission mechanism 32 against the drive spring 31. The head section 15 of the drive-in ram 13, together with the surrounding transmission element 33, extends into a cylindrical guide chamber 37 which is defined by the output element 35, drive spring 31, and the abutment 36. With the head section 15 of the drive-in ram 13 being guided in guide chamber 37 between these elements and, in particular, within the drive spring 31, advantageously, a compact construction is obtained.

In the initial position 22, the drive-in ram 13 is held with a locking device generally indicated with a reference numeral 50. The locking device 50 has a pawl 51 that engages, in a locking position 54 (see FIG. 1), a locking surface 53 of a projection 58 of the drive-in ram 13, holding the drive-in ram 13 against the biasing force of the drive spring 31. The pawl 51 is supported on a servomotor 52 and is displaced thereby into a release position 55 shown in FIG. 2, which would be described in detail further below. An electrical first control conductor 56 connects the servomotor 52 with a control unit 23.

The drive-in power tool 10 further has a handle 20 on which there is provided an actuation switch 19 for initiating a drive-in process with the drive-in power tool 10. In the handle 20, there is further arranged a power source generally indicated with a reference numeral 21 and which provides electrical energy for the power tool 10. In the embodiment described here, the power source 21 contains at least one accumulator. The power source 21 is connected by electrical conductors 24 with both the control unit 23 and the actuation switch 19. The control unit 23 is also connected with the actuation switch 19 by a switch conductor 57.

At a mouth 62 of the drive-in power tool 10, there is provided switch means 29 which is electrically connected with the control unit 23 by an electrical conductor 28. The switch means 29 communicates an electrical signal to the control unit 23 as soon as the drive-in power tool 10 is pressed against a constructional component U, as shown in FIG. 2, which insures that the drive-in power tool 10 only then can be actuated when it is properly pressed against the constructional component.

On the drive-in power tool 10, there is further arranged a tensioning device generally indicated with a reference numeral 70. The tensioning device 70 has a motor 71 for driving a drive roller 72. The motor 71 is connected with the control unit 23 by a second control conductor 74 and is actuated by the control unit 23 when, e.g., the drive-in ram 13 is located in its end, in the drive-in direction 27, position or when the drive-in power tool 10 is lifted off the constructional component. The motor 71 has output means 75 such as, e.g., an output gear, connected with a drive roller 72. The drive roller 72 is rotatably supported on a longitudinally adjustable arm 78 of adjusting means 76 formed as a solenoid. The adjusting means 76 is connected with the control unit 23 by an adjusting conductor 77. During the operation, the drive roller 72 rotates in a direction of arrow 73 which is shown with dash lines.

When the drive-in power tool is actuated with a main switch, not shown, the control unit 23 insures that the drive-in ram 13 remains in its initial position shown in FIG. 1. If this is not the case, then the drive roller 72 of the adjusting means 76 is displaced toward output gear 75, which is rotated by the motor 71, and engages the output gear 75. Simultaneously, the drive roller 72 engages the drive-in ram 13 which is displaced by the drive roller 72, which rotates in the direction shown with arrow 73, in a direction of the drive means 30, preloading the drive spring 32 of the drive means 30.

When the drive-in ram 13 reaches its initial position 22, the pawl 51, pivoting about its axis, engages the locking surface 53 of the projection 58, retaining the drive-in ram 13 in the initial position 22. Then, the motor 71 can be turned off by the control unit 23. At the same time, the adjusting means 76, under control of the control unit 23, displaces the drive roller 72 from its engagement position with the output means 75 and the drive-in ram 13 to its disengagement position (see FIG. 2).

When the drive-in tool 10 is pressed against the constructional component U, then control means 23 is shifted by the switch means 29 to its drive-in ready position. Then, when the actuation switch 19 is actuated by the tool user, the control unit 23 displaces the locking device 50 into its release position 55, whereby the pawl 51 is lifted by the servomotor 52 off the locking surface 53 of the drive-in ram 13. The pawl 51 is biased in the direction of the drive-in ram 13.

The drive-in ram 13, upon being released by the locking device 50, is displaced by the drive spring 31 of the drive means 30 in the drive-in direction, driving a fastening element 60, which is located in the bolt guide 17, in the constructional component U. Advantageously, the expansion path (arrow 45) of the drive spring 31 is so converted by the transmission mechanism 32 that the acceleration path (arrow 44) of the drive-in ram 13 is longer than the expansion path (arrow 45) of the drive spring 31. The transmission ratio of the transmission mechanism 32 amount, in the embodiment discussed here, to 1:2.

For returning the drive-in ram 13 and for preloading the drive spring 31, at the end of the drive-in process, the tensioning device 70 is actuated by the control unit 23 when the drive-in power tool 10 is lifted off the constructional component U. Upon the power tool 10 being lifted off, the switch means 29 communicates a signal to the control unit 23. The tensioning device 70 displaces the drive-in ram 13, in a manner described above, against the drive spring 31 until the pawl 51 engages, in its locking position 54, the locking surface 53 of the drive-in ram 13.

Figure 3:
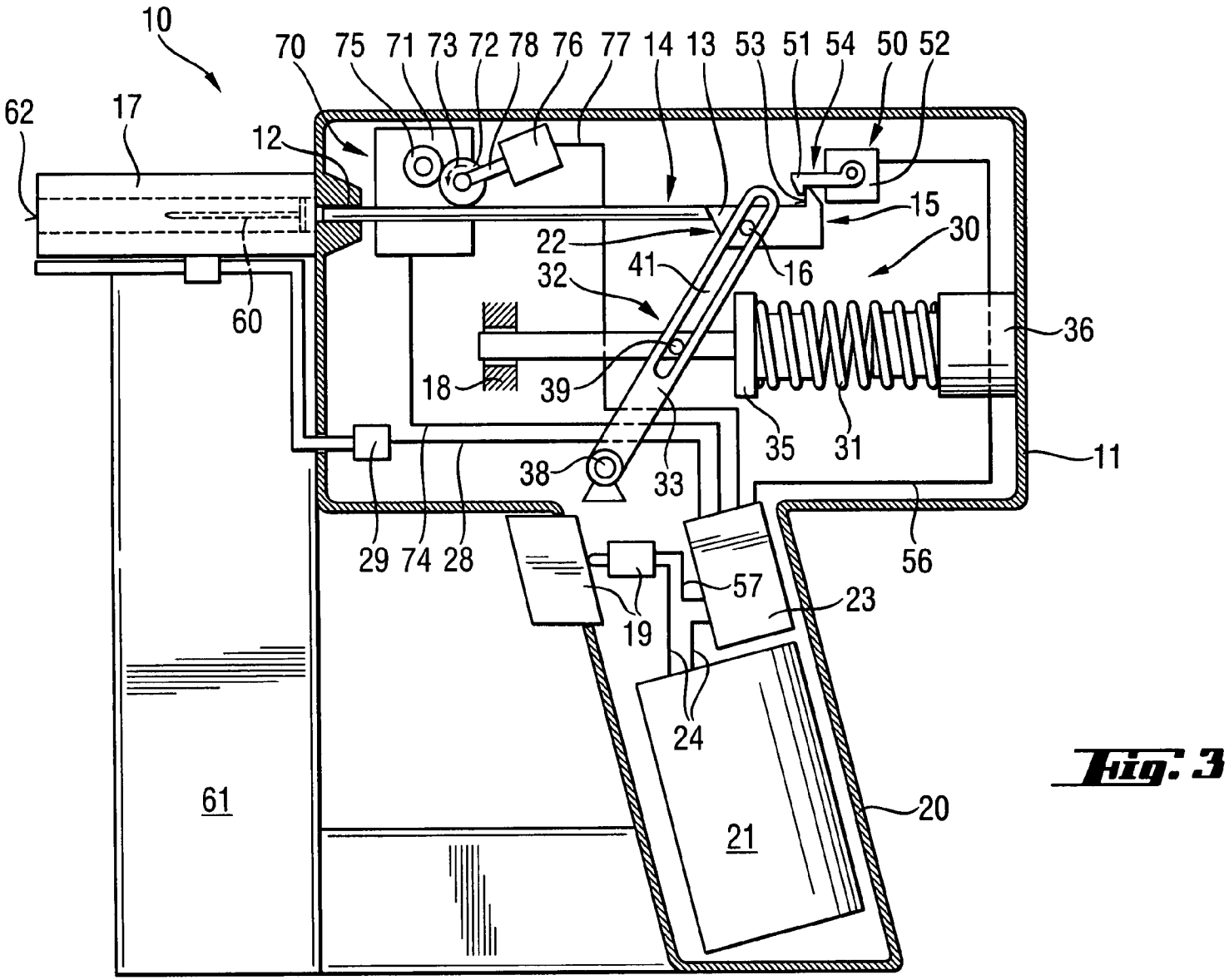
FIG. 3 a longitudinal view of a further embodiment of a drive-in power tool according to the present invention in its initial position.
Figure 4:
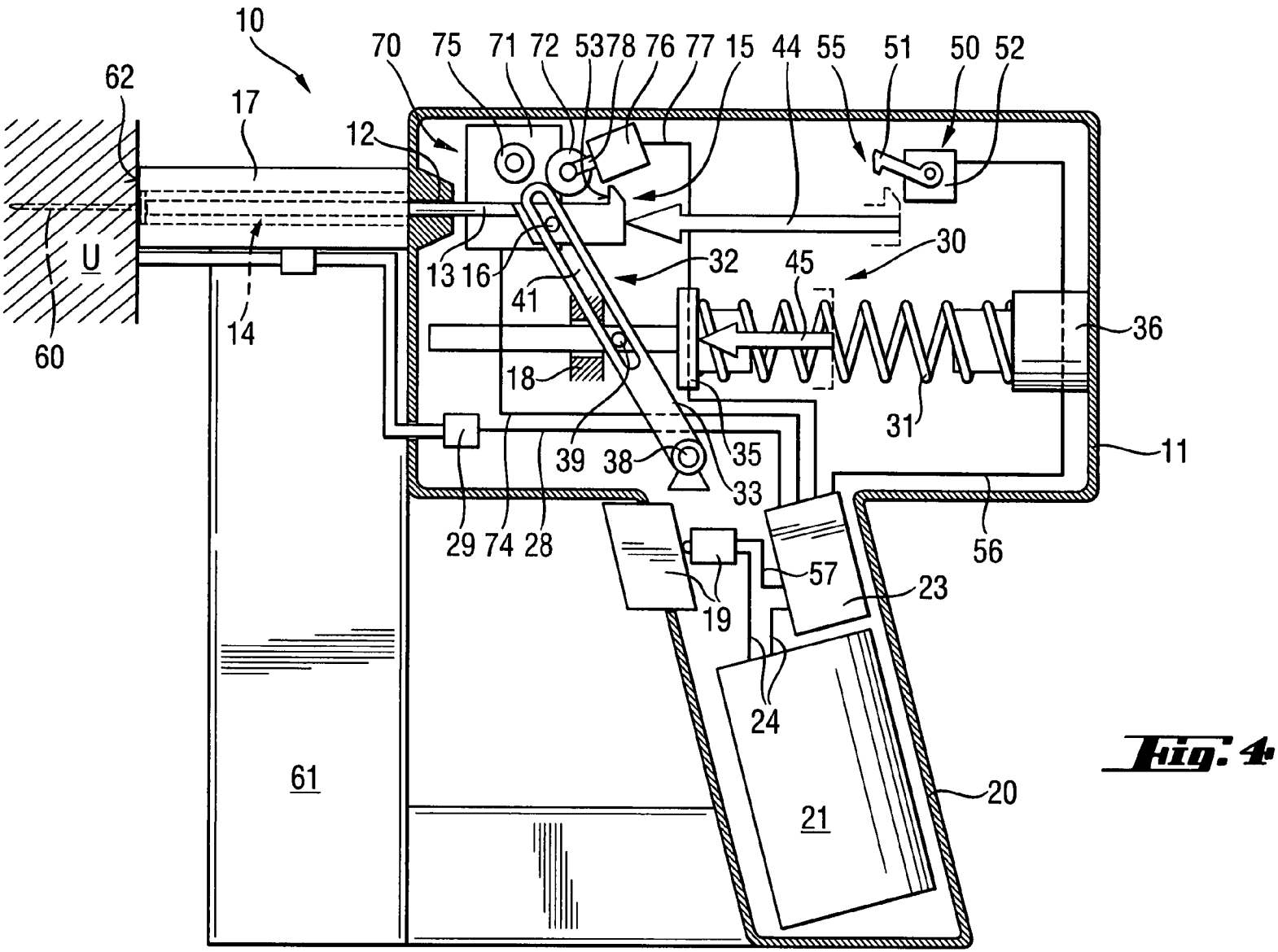
FIG. 4 a longitudinal view of the drive-in power tool according to FIG. 3 in its operational position.

A drive-in power tool 10, which is shown in FIGS. 3-4, differs from that shown in FIG. 1-2 by the construction of the transmission mechanism 32. In the embodiment of the subject tool shown in FIGS. 3-4, the transmission mechanism 32 is formed as a link mechanism and has a transmission element 33 formed as a lever arm supported by a drag bearing 38 in the drive-in power tool 10. The lever arm is provided above its support point with an elongate guide link 41. An output pin 39 of a spring output element 35 engages in an end region of the link 41 adjacent to the drag bearing 38, and an entraining element 16, which is formed as ram, engages in an end region of the guide link 41 remote from the drag bearing 38. The entraining element 16 is arranged sidewise on the drive-in ram 13. The spring output element 35 is also formed as a ram displaceable supported with its end region remote from the drive spring 31 in a ram guide 18 fixed in the housing 11 of the drive-in power tool 10. The drive spring 31 transmits, upon release of the drive-in ram 13 by the locking device 50, its expansion movement by the output pin 39 to the transmission mechanism 32 which is formed as the lever arm. The transmission mechanism 32 transmits the movement or expansion of the drive spring 31 to the drive-in ram 13 via the entraining element 16. The transmission ratio in this embodiment also amounts to about 1:2, i.e., the acceleration path (arrow 44) of the drive-in ram 13 is twice as long as the expansion path (arrow 45) of the drive spring 31. For other details which are not discussed here, reference is made to the preceding description with reference to FIGS. 1-2.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A hand-held drive-in power tool for driving in fastening elements, comprising:

a guide (12);

a drive-in ram (13) displaceable in the guide (12);

drive means (30) for driving the drive-in ram (13) and including at least one preloaded drive spring (31);

a tensioning device (70) including:

a motor (71) for displacing the drive-in ram (13) in a direction opposite to the drive-in direction (27) for preloading the drive spring (31);

a transmission mechanism (32) arranged between the drive spring (31) and the drive-in ram (13), wherein an expansion path (45) of the drive spring (31) is converted by the transmission mechanism (32) to cause an acceleration path (44) of the drive-in ram (13) to be longer than the expansion path (45) of the drive spring (31); and a locking device (50) for holding the drive-in ram (13) against the biasing force of the drive spring (31);

wherein the transmission mechanism (32) is a rope drive.

2. The drive-in power tool according to claim 1, wherein a transmission element (33) of the transmission mechanism (32) is formed of a rope.

3. The drive-in power tool according to claim 1, wherein a transmission element (33) of the transmission mechanism (32) is formed of a band of material.

* * * * *